US006461199B1

(12) United States Patent
Koga et al.

(10) Patent No.: US 6,461,199 B1
(45) Date of Patent: Oct. 8, 2002

(54) MULTIPLE ELECTRODE CONNECTING APPARATUS

(76) Inventors: Nobutaka Koga, 2-32-2 Kamat, Ohta-ku, Tokyo 144-0082 (JP); Tadao Tonegawa, 9-5-1 Iriya, Adachi-Ku, Tokyo 181-0938 (JP)

( * ) Notice: Subject to any disclaimer, the term of this patent is extended or adjusted under 35 U.S.C. 154(b) by 0 days.

(21) Appl. No.: 09/880,625

(22) Filed: Jun. 12, 2001

(51) Int. Cl.[7] ..... H01R 24/04

(52) U.S. Cl. ..... 439/668; 439/669; 439/675

(58) Field of Search ..... 439/668, 669, 439/675, 188

(56) References Cited

U.S. PATENT DOCUMENTS 5,934,924 A * 8/1999 Suzuki ..... 439/668
6,220,899 B1 * 4/2001 Suzuki ..... 439/669
6,270,380 B1 * 8/2001 Shichida ..... 439/669

FOREIGN PATENT DOCUMENTS

DE 3605076 A1 * 8/1987 ..... 439/668

* cited by examiner

*Primary Examiner*—Tho D. Ta
(74) *Attorney, Agent, or Firm*—Gregory Smith & Associates

(57) ABSTRACT

A multiple electrode connecting for connecting multiple circuits, such as the headphones of a portable tape recorder or CD player. The multiple electrode connection comprises apparatus comprising a connection plug and a connection jack. The plug is equipped with a rod-shaped insertion part that comprises a first annular contact, a second annular contact, a third annular contact, and a fourth annular contact. Each contact is provided in sequence with an insulating material disposed there between. A cylindrical insertion part made of an insulating material is formed concentrically around the outside of rod-shaped insertion part at a position closer to the base end part thereof. A fifth annular contact and a sixth annular contact are sectionally formed on the outside of the cylindrical insertion part. A seventh annular contact and an eighth annular contact are sectionally formed on the inside of the cylindrical insertion part.

6 Claims, 4 Drawing Sheets

MULTIPLE ELECTRODE CONNECTING APPARATUS

FIELD OF THE INVENTION

The present device relates to a multiple electrode connecting apparatus comprising a connection plug and a connection jack for connecting multiple circuits, such as the headphones of a portable tape recorder or CD player.

DESCRIPTION OF RELATED ART

A conventional multiple electrode connecting apparatus of this type is described in Japanese Laid-open Patent Publication No. 4-118879. The connecting apparatus described in Japanese Laid-open Patent Application No. 4-118879 is configured to achieve connections for six contacts. However, recent electric devices have multiple functions; for example, the headphones that connect to a portable CD player are provided with functions for executing various player operations remotely. The larger the number of connection terminals, the larger the number of remote operations that can be executed.

The present device seeks to provide a new multiple electrode connecting apparatus that enables the connection of eight contacts (which is a significant increase in the number of electrodes) and is also compact in form despite its multiple electrodes.

SUMMARY OF THE INVENTION

The present device is a multiple electrode connecting apparatus having a plug equipped with a rod-shaped insertion part that comprises a first annular contact, a second annular contact, a third annular contact, and a fourth annular contact, each provided in sequence with an insulating material disposed there between. The plug is provided with a cylindrical insertion part made of an insulating material and formed concentrically around the outside of rod-shaped insertion part at a position closer to the base end part thereof. A fifth annular contact and a sixth annular contact are sectionally formed on the outside of the cylindrical insertion part so as to be insulated from each other. A seventh annular contact and an eighth annular contact are sectionally formed on the inside of the cylindrical insertion part so as to be insulated from each other.

Furthermore, the seventh annular contact and eighth annular contact are sectionally formed on the inside surface of the cylindrical insertion part and the fifth annular contact and sixth annular contact are ectionally formed on the outside surface of the same are configured so that a lead piece is provided on the base end edge of each ring-shaped contact portion.

By adopting the configuration described above, the present device solves the previously described problems of the prior art. In addition to enabling multiple-electrode connection of eight contacts, the overall structure is made more compact.

BRIEF DESCRIPTION OF THE DRAWINGS

A preferred embodiment of the present invention is further described in connection with the accompanying drawings, in which.

DETAILED DESCRIPTION OF THE INVENTION

The following description is provided to enable any person skilled in the art to make and use the invention and sets forth the best mode presently contemplated by the inventor of carrying out his invention. Various modifications, however, will remain readily apparent to those skilled in the art, as generic principles of the present invention have been defined herein.

The present device is a multiple electrode connecting apparatus having a plug equipped with a rod-shaped insertion part that comprises a first annular contact, a second annular contact, a third annular contact, and a fourth annular contact. Each contact is provided in sequence with an insulating material disposed there between. The connection plug is provided with a cylindrical insertion part made of an insulating material and formed concentrically around the outside of rod-shaped insertion part at a position closer to the base end part thereof. A fifth annular contact and a sixth annular contact are sectionally formed on the outside of the cylindrical insertion part so as to be insulated from each other. A seventh annular contact and an eighth annular contact are sectionally formed on the inside of the cylindrical insertion part so as to be insulated from each other. Furthermore, the seventh annular contact and eighth annular contact are sectionally formed on the inside surface of the cylindrical insertion part. The fifth annular contact and sixth annular contact are sectionally formed on the outside surface of the cylindrical insertion part and are configured so that a lead piece is provided on the base end edge of each ring-shaped contact portion.

Reference will now be made in detail to a presently preferred embodiment of the invention as illustrated in the accompanying drawings. The drawings show a multiple electrode connecting apparatus as best seen in FIG. 1.

Figure 1:
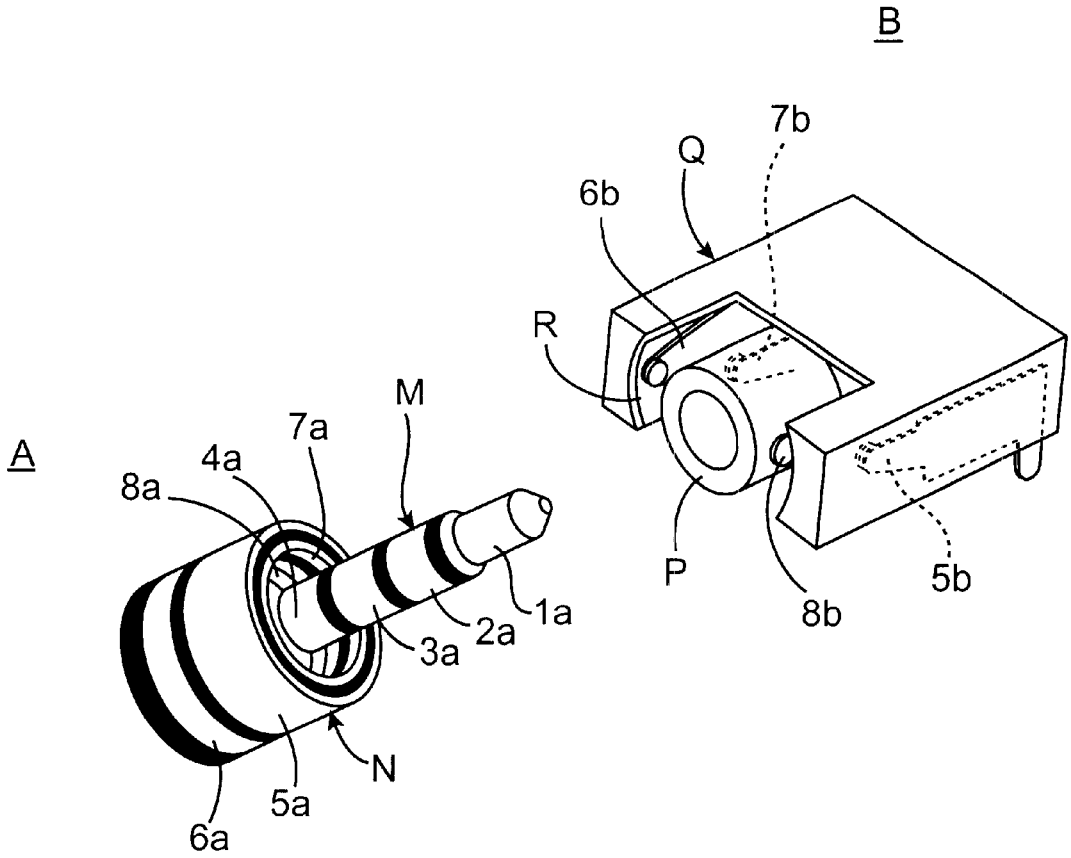
FIG. 1 is a perspective view showing the key components of a multiple electrode connecting apparatus in accordance with the present device.

FIG. 1 is a perspective view showing the key components of a connecting apparatus in accordance with the present device. In the same figure, A is the connection plug and B is the connection jack.

Connection plug A is configured so that cylindrical insertion part N, which is made of an insulating material, is formed concentrically around the outside of rod-shaped insertion part M at a position closer to the base end part thereof.

Connection jack B is provided with a receiving cylinder part P for inserting rod-shaped insertion part M of connection plug A and a cover-like frame part Q formed concentrically and with a prescribed spacing with respect to the outside of receiving cylinder part P so arranged that a receiving space R for cylindrical insertion part N of connection plug A is formed by the outside surface of cylinder part P and the inside surface of cover-like frame part Q.

Figure 2:
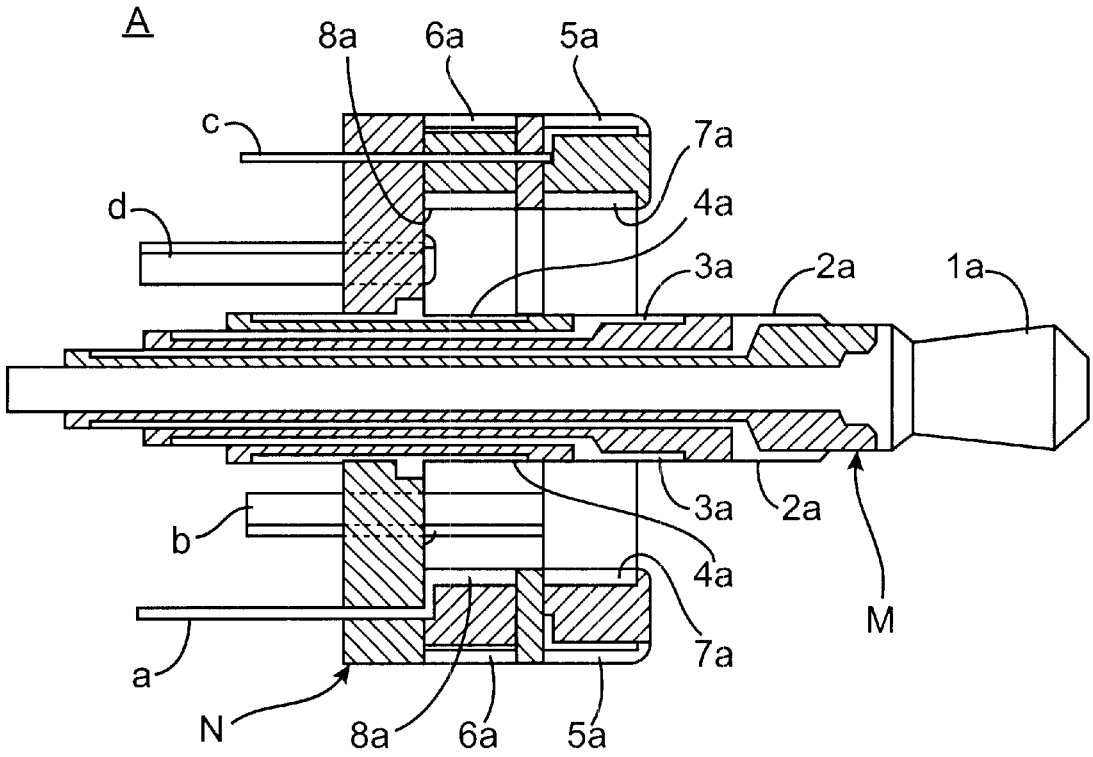
FIG. 2 is a vertical cross section showing the key components of the connection plug of the present device.

As shown in FIGS. 1 and 2, connection plug A is configured so that first annular contact 1*a*, second annular contact 2*a,* third annular contact 3*a,* and fourth annular contact 4*a* are provided in sequence on rod-shaped connection part M starting from the tip thereof and an insulating material is disposed between said contacts. This kind of contact arrangement for a rod-shaped connection part is in the realm of publicly known technology.

Figure 3:
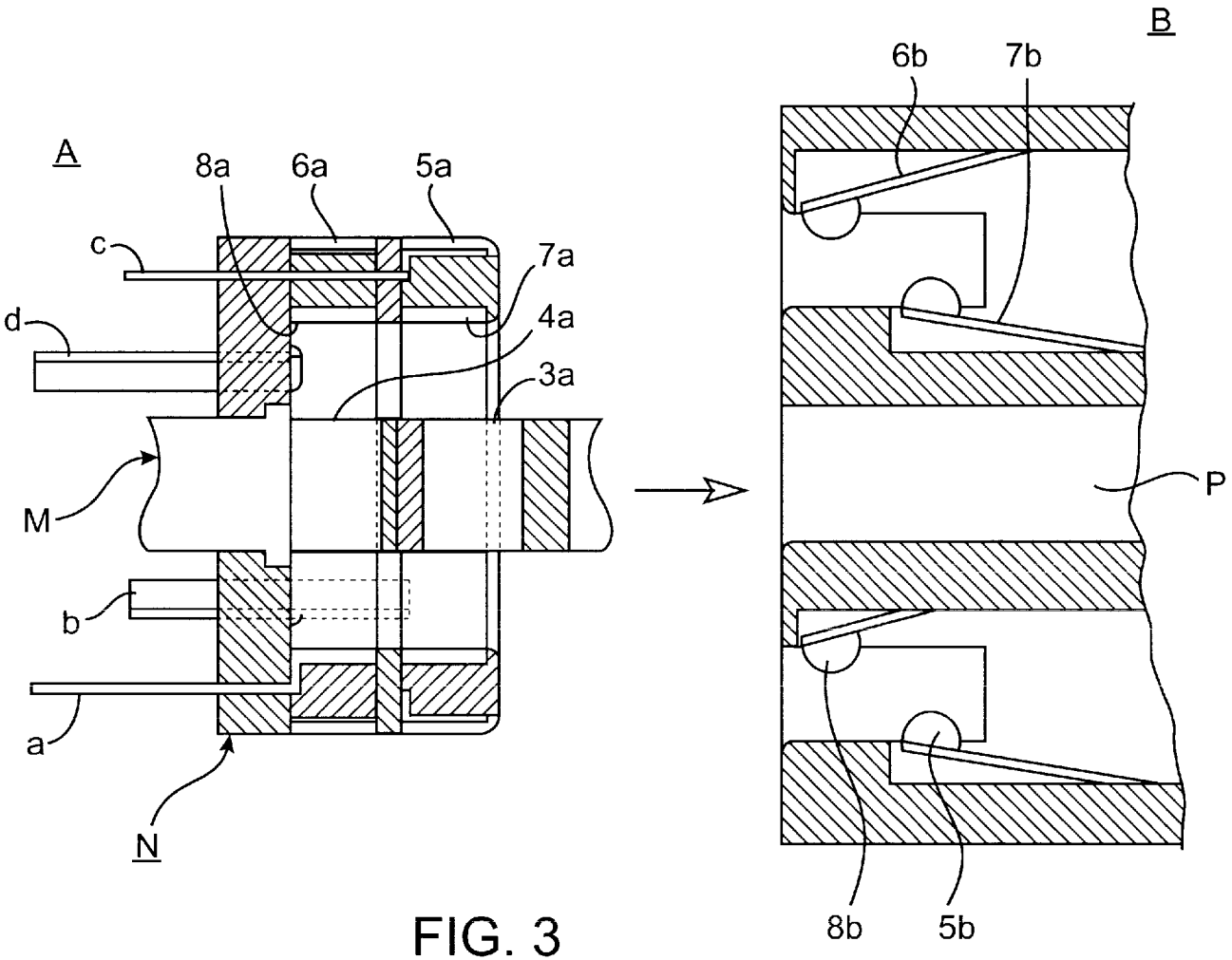
FIG. 3 is a vertical cross section showing the key components of a multiple electrode connecting apparatus in accordance with the present device.

In FIG. 2 and FIG. 3 (discussed later) the insulating material is shown with crosshatching and the contact portions are shown without crosshatching. This is done intentionally so that the insulating material and the contact portions can be clearly distinguished and easily discerned.

Cylindrical insertion part N is made of an insulating material and fifth annular contact 5*a* and sixth annular contact 6*a* are sectionally formed on the outside thereof so as to be insulated from each other. Additionally, seventh annular contact 7*a* and eighth annular contact 8*a* are sectionally formed on the inside of said cylindrical insertion part N so as to be insulated from each other. In other words, cylindrical insertion part N is provided with a total of four contacts: two on the inside and two on the outside.

Thus, as shown in FIG. 3, the contacts of cylindrical insertion part N are arranged so that fifth annular contact 5*a* is overlappingly affixed to the outside surface of cylindrical insertion part N on the half that includes the tip thereof and annular contact 7*a* is overlappingly affixed to the inside surface of the same. Meanwhile, annular contact 6*a* is overlappingly affixed to the outside surface of cylindrical insertion part N on the half of that includes the base end thereof and annular contact 8*a* is overlappingly affixed to the inside surface of the same. As a result, cylindrical insertion part N is provided with a total of four contacts—two each on the inside and outside surfaces—that are insulated from each other.

Figure 4:
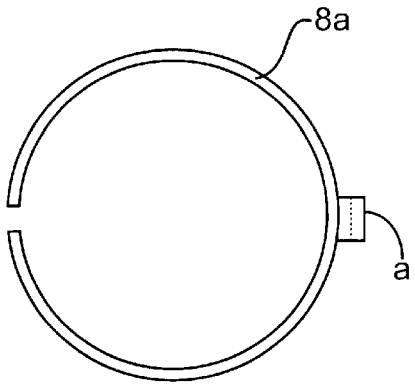
FIG. 4 is a plan view of the eighth annular contact of the present device.
Figure 5:
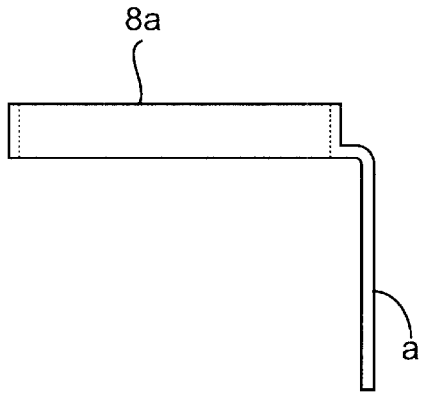
FIG. 5 is a frontal view of the eighth annular contact of the present device.

FIGS. 4 and 5 show eighth annular contact 8*a*. The eighth annular contact has a lead piece a provided on the base end edge of the ring-shaped contact portion.

Figure 6:
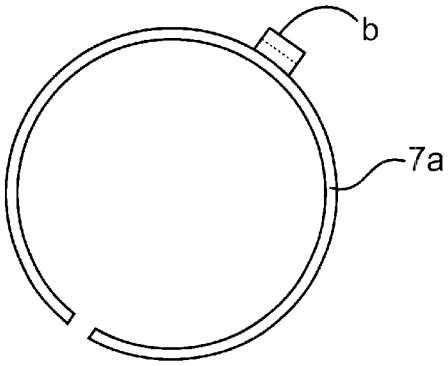
FIG. 6 is a plan view of the seventh annular contact of the present device.
Figure 7:
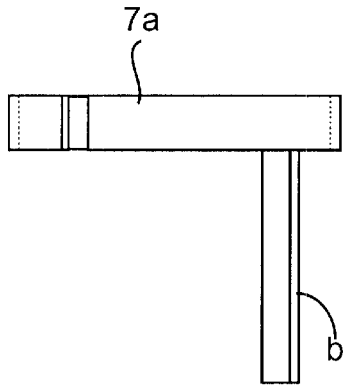
FIG. 7 is a frontal view of the seventh annular contact of the present device.

FIGS. 6 and 7 show seventh annular contact 7*a*. The seventh annular contact has a lead piece b provided on the base end edge of the ring-shaped contact portion.

Similarly, the fifth annular contact 5*a* and sixth annular contact 6*a* provided on the outside of cylindrical insertion part N, are configured so as to have lead pieces c and d, respectively, provided on the base end edge of the ring-shaped portion.

Additionally, as shown in FIGS. 4 to 7, the form of each annular contact is a preferably an O-ring shape. However, in alternate embodiments, a C-ring shape may be used by providing a slit in the ring-shaped portion that forms the contact portion. In such embodiments the spring action provided by the C-ring shape can be utilized to fix the contacts to cylindrical insertion part N in a pressure fit-like manner. This kind of form is the preferred mode of operation for the present device.

As shown in FIGS. 2 and 3, the lead pieces a, b, c, and d of fifth to eighth annular contacts 5*a,* 6*a,* 7*a,* and 8*a* are each provided with their phases offset from one another. As a result, the leads can be drawn out while maintaining their insulated state with respect to one another. Simultaneously, the relevant parts can be made more compact by adopting such an arrangement because the objective of attaching four annular contacts to the inside and outside surfaces of cylindrical insertion part N is accomplished. In short, when separate insulation material is added for the leads of the contacts, the relevant parts inevitably become larger in diameter. However, with the configuration described here, the size of the relevant parts can be minimized.

As shown in FIGS. 1 and 3 and described earlier, connection jack B is provided with a receiving cylinder part P for inserting rod-shaped insertion part M of connection plug A and a cover-like frame part Q formed concentrically and with a prescribed spacing with respect to the outside of receiving cylinder part P, the two parts being so arranged that a receiving space R for cylindrical insertion part N of connection plug A is formed by the outside surface of cylinder part P and the inside surface of cover-like frame part Q.

Meanwhile, sixth spring-like contact 6*b* for connecting with sixth annular contact 6*a* is attached closer to the tip of the inside surface of said cover-like frame part Q and fifth spring-like contact 5*b* for connecting with fifth annular contact 5*a* is attached somewhat more toward the inner portion of the same.

Also, eighth spring-like contact 8*b* for connecting with eighth annular contact 8*a* is attached closer to the tip of the outside surface of receiving cylinder part P and seventh spring-like contact 7*b* for connecting with the seventh annular contact 7*a* is attached somewhat more toward the inner portion of the same.

Each of the annular contacts and spring-like contacts are arranged so that they accomplish a prescribed wire connection and are electrically connected when plug A is inserted into jack B.

In short, when plug A is inserted into jack B, the first annular contact 1*a,* second annular contact 2*a,* third annular contact 3*a,* and fourth annular contact 4*a* of rod-shaped part M of plug A are connected by contacting a first spring-like contact, second spring-like contact, third spring-like contact, and fourth spring-like contact, which are provided in sequence in positions that are somewhat offset from one another on the inside surface of receiving cylinder part P.

Meanwhile, the fifth annular contact 5*a,* sixth annular contact 6*a,* seventh annular contact 7*a,* and eight annular contact 8*a* provided on cylindrical insertion part N of plug A are connected by contacting the fifth spring-like contact 5*b,* sixth spring-like contact 6*b,* seventh spring-like contact 7*b,* and eighth spring-like contact 8*b* of jack B.

When plug A is inserted into jack B, the first annular contact 1*a,* second annular contact 2*a,* third annular contact 3*a,* and fourth annular contact 4*a* of rod-shaped part M of plug A are connected by contacting a first spring-like contact, second spring-like contact, third spring-like contact, and fourth spring-like contact, respectively, which are provided in sequence in positions that are somewhat offset from one another on the inside surface of receiving cylinder part P.

Meanwhile, the fifth annular contact 5*a,* sixth annular contact 6*a,* seventh annular contact 7*a,* and eight annular contact 8*a* of cylindrical insertion part N of plug A are connected by contacting the fifth spring-like contact 5*b,* sixth spring-like contact 6*b,* seventh spring-like contact 7*b,* and eighth spring-like contact 8*b,* respectively, of jack B.

With the connections described here, the objective of providing eight contact connections between plug A and jack B is accomplished.

The preferred embodiments described herein are illustrative only, and although the examples given include many specificities, they are illustrative of only a few possible embodiments of the invention. Other embodiments and modifications will, no doubt, occur to those skilled in the art. The examples given should only be interpreted as illustrations of some of the preferred embodiments of the invention, and full scope of the invention should be determined by reference to the appended claims and their legal equivalents.

What is claimed is:

1. A multiple electrode connecting apparatus comprising:

a plug with a rod-shaped insertion part, said rod shaped insertion part comprising a first annular contact, a second annular contact, a third annular contact, and a fourth annular contact, each said contact provided in sequence with an insulating material disposed there between, a cylindrical insertion part comprising an insulating material, and having an inner surface and an outer surface, and being positioned concentrically around said rod-shaped insertion part with a gap between said rod-shaped insertion part and said inner surface of said cylindrical insertion part, a fifth annular contact and a sixth annular contact formed on said outer surface of said cylindrical insertion part so as to be insulated from each other; and a seventh annular contact and an eighth annular contact formed on said inner surface of said cylindrical insertion part so as to be insulated from each other.

2. The multiple electrode connecting apparatus of claim 1, wherein said seventh annular contact and said eighth annular contact formed on said inner surface of said cylindrical insertion part and said fifth annular contact and said sixth annular contact are formed on said outer surface of said cylindrical insertion part and are configured so that a lead piece is provided on a base end edge of each of said fifth, sixth, seventh, and eighth annular contact.

3. The multiple electrode connecting apparatus of claim 2, wherein at least one of said fifth, sixth, seventh, and eighth annular contacts comprises a C-ring shape.

4. The multiple electrode connecting apparatus of claim 1, further comprising a connection jack configured to receive said plug.

5. The multiple electrode connecting apparatus of claim 4, wherein said connection jack comprises:

a receiving cylinder part having an aperture for receiving said rod-shaped insertion part of said plug, an inner surface within said aperture, and an exterior surface, said cylinder part being configured to be accepted within said gap between said rod-shaped insertion part and said inner surface of said cylindrical insertion part, a housing part including at least one interior surface positioned a selected distance from said outside surface of said receiving cylinder part so as to define an opening configured to accept said cylindrical insertion part of said connection plug, a contact for connecting with said fifth annular contact coupled to an interior surface of said housing part, a contact for connecting with said sixth annular contact coupled to an interior surface of said housing part, a contact for connecting with said seventh annular contact positioned on said outer surface of said receiving cylinder part, a contact for connecting with said eighth annular contact positioned on said outer surface of said receiving cylinder part.

6. The multiple electrode connecting apparatus of claim 3, further comprising a connection jack configured to receive said plug, said connection jack comprising:

a receiving cylinder part having an aperture for receiving said rod-shaped insertion part of said plug, an inner surface within said aperture, and an exterior surface, said cylinder part being configured to be accepted within said gap between said rod-shaped insertion part and said inner surface of said cylindrical insertion part, a housing part including at least one interior surface positioned a selected distance from said outside surface of said receiving cylinder part so as to define an opening configured to accept said cylindrical insertion part of said connection plug, a contact for connecting with said fifth annular contact coupled to an interior surface of said housing part, a contact for connecting with said sixth annular contact coupled to an interior surface of said housing part, a contact for connecting with said seventh annular contact positioned on said outer surface of said receiving cylinder part, a contact for connecting with said eighth annular contact positioned on said outer surface of said receiving cylinder part.

* * * * *